United States Patent [19]

Suga

[11] Patent Number: 4,798,331

[45] Date of Patent: Jan. 17, 1989

[54] ARTIFICIAL SNOW PRODUCTION APPARATUS

[75] Inventor: Nagaichi Suga, Tokyo, Japan

[73] Assignee: Suga Test Instruments Co., Ltd., Tokyo, Japan

[21] Appl. No.: 137,716

[22] Filed: Dec. 24, 1987

[30] Foreign Application Priority Data

Dec. 24, 1986 [JP] Japan ..... 61-310436

[51] Int. Cl.[4] ..... A01H 15/00

[52] U.S. Cl. ..... 239/14.2; 239/2.2

[58] Field of Search ..... 239/2.2, 14.1, 14.2

[56] References Cited

U.S. PATENT DOCUMENTS

| | | | |
|---|---|---|---|
| 1,104,920 | 7/1914 | Osborne | 62/74 |
| 1,748,043 | 2/1930 | Grupe | 239/2.2 |
| 3,257,815 | 6/1966 | Brocoff et al. | 62/74 |
| 3,464,625 | 9/1969 | Carlsson | 239/14.2 |
| 3,733,029 | 5/1973 | Eustis et al. | 239/14.2 |
| 3,761,020 | 9/1973 | Tropeano et al. | 239/2.2 |
| 3,945,567 | 3/1976 | Rambach | 239/14.2 |
| 3,952,949 | 4/1976 | Dupre | 239/2.2 |
| 3,964,682 | 6/1976 | Tropeano et al. | 239/2.2 |
| 4,129,252 | 12/1978 | Pouring | 239/2.2 |
| 4,200,228 | 4/1980 | Woerpel | 239/2.2 |

FOREIGN PATENT DOCUMENTS

| | | | |
|---|---|---|---|
| 1372024 | 8/1964 | France | 239/14.2 |

*Primary Examiner*—Andres Kashnikow
*Assistant Examiner*—Patrick N. Burkhart
*Attorney, Agent, or Firm*—Wenderoth, Lind and Ponack

[57] ABSTRACT

An artificial snow generating apparatus having a vertical inner cylinder for generating and growing snow and an outer tank surrounding the inner cylinder and having a cooler for cooling the inner cylinder for an ice crystal quantitative feeder for generating and feeding a predetermined quantity of ice to a lower part of the inner cylinder from a cooled spray chamber into which a spray producing nozzle sprays water from a feed water tank by aspiration with air from a saturation tank containing water. A blower periodically blows humidified air through the spray chamber to blow ice particles into the inner cylinder. The apparatus also has a cloud-forming water quantitative feeder for generating and feeding a predetermined quantity of particles of cloud-forming water having a predetermined particle size to the inner cylinder at a position above the ice crystal quantitative feeder. Compressed air from a compressor is directed through water in a further saturation tank and into a classification pipe through a further nozzle to produce a spray of water particles into the classification pipe from the further feed water tank, and the particle classification pipe separates particles larger than a predetermined size from the spray of water particles and passes the remainder of the water particles into the inner cylinder.

3 Claims, 3 Drawing Sheets

ARTIFICIAL SNOW PRODUCTION APPARATUS

BACKGROUND OF THE INVENTION

This invention relates to an improved apparatus for producing artificial snow which can generate artificially a predetermined quantity of snow having a predetermined quality and cause it to fall like natural snow for use in various studies and experiments.

One type of prior art artificial snow producing apparatuses freezes fine mist-like water droplets to generate ice particles, and another apparatus which generates snow identical to natural snow is disclosed in Japanese Patent Laid-Open Application No. 165,566/1986, and in U.S. patent application Ser. No. 920,194 filed Oct. 17, 1986.

The prior art apparatus of the Japanese Laid-Open Application will be described with reference to FIG. 4 of the accompanying drawings. The snow producing apparatus comprises an erect cooling tower 4, a snow collecting chamber 1 which is connected to the bottom of the cooling tower 4 and the opening 3 in the ceiling portion of which is covered by the cooling tower 4, a first cooler 9 for cooling the air inside the cooling tower 4, an inner cylinder 12 which extends vertically inside the cooling tower 4 and has a bottom opening connected to the opening 3 of the snow collecting chamber 1, a circulation pipe 13 which connects the top of the inner cylinder 12 to its lower end portion, a variable speed blower 14 disposed at an intermediate portion of the circulation pipe 13, a humidifier 15 which supplies moisture into the inner cylinder 12 near the lower end portion of the inner cylinder 12, and a snow seed feeder which supplies ice crystals into the inner cylinder near the humidifier 15.

However, the ice particles obtained by freezing the mist-like water droplets by the one type of prior art apparatus described above are mere ice particles, and have an entirely different quality from crystallized natural snow. Although such ice particles can be used for an artificial skiing area or for decoration, they cannot be used for studies and experiments involving natural snow.

The apparatus disclosed in the Japanese Patent Laid-Open Application and as described in connection with FIG. 4 can generate artificial snow which is equivalent to crystallized natural snow, but the shapes of the crystal structures of the resulting snow are diversified and, moreover, it is difficult to obtain a predetermined quantity of snow in conjunction with the quantity of snowfall. Accordingly, this prior art apparatus is subject to the problems that the shape of the snowflakes is not constant and at the time, the quantity of snowfall cannot be controlled arbitrarily.

Obtaining snow with a predetermined shape of the snowflakes from the artificial snow generating apparatus and the arbitrary control of the quantity of snow are indispensable conditions for carrying out studies and experiments to solve various problems caused by snow.

Accordingly, the development of an artificial snow generating apparatus which can generate a predetermined quantity of snow having flakes of a predetermined shape has been needed.

SUMMARY OF THE INVENTION

It is an object of the present invention to provide an apparatus to satisfy the need described above. To this end, the present invention provides an artificial snow generating apparatus which has an ice crystal quantitative feeder as well as a cloud water quantitative feeder inside an artificial snow generating apparatus having an inner cylinder which generates and grows the snowflakes vertically positioned in an outer tank for cooling the inner cylinder, and the artificial snow generating apparatus of the invention can generate a predetermined quantity of the snow having flakes of a predetermined shape.

It is another object of the present invention to provide an artificial snow generating apparatus which can establish the particle size of ice crystals that serve as the nuclei of the snowflakes, which is the significant factor for determining the shape of the flakes and which can establish and quantitatively supply the ice crystals and water into an inner cylinder of the snow generating apparatus to control the quantity of the snow, whereby artificial snow for use in various studies and experiments can be easily produced.

BRIEF DESCRIPTION OF THE DRAWINGS

The invention will now be described in detail in connection with the accompanying drawings, in which.

DETAILED DESCRIPTION OF THE INVENTION

Figure 1:
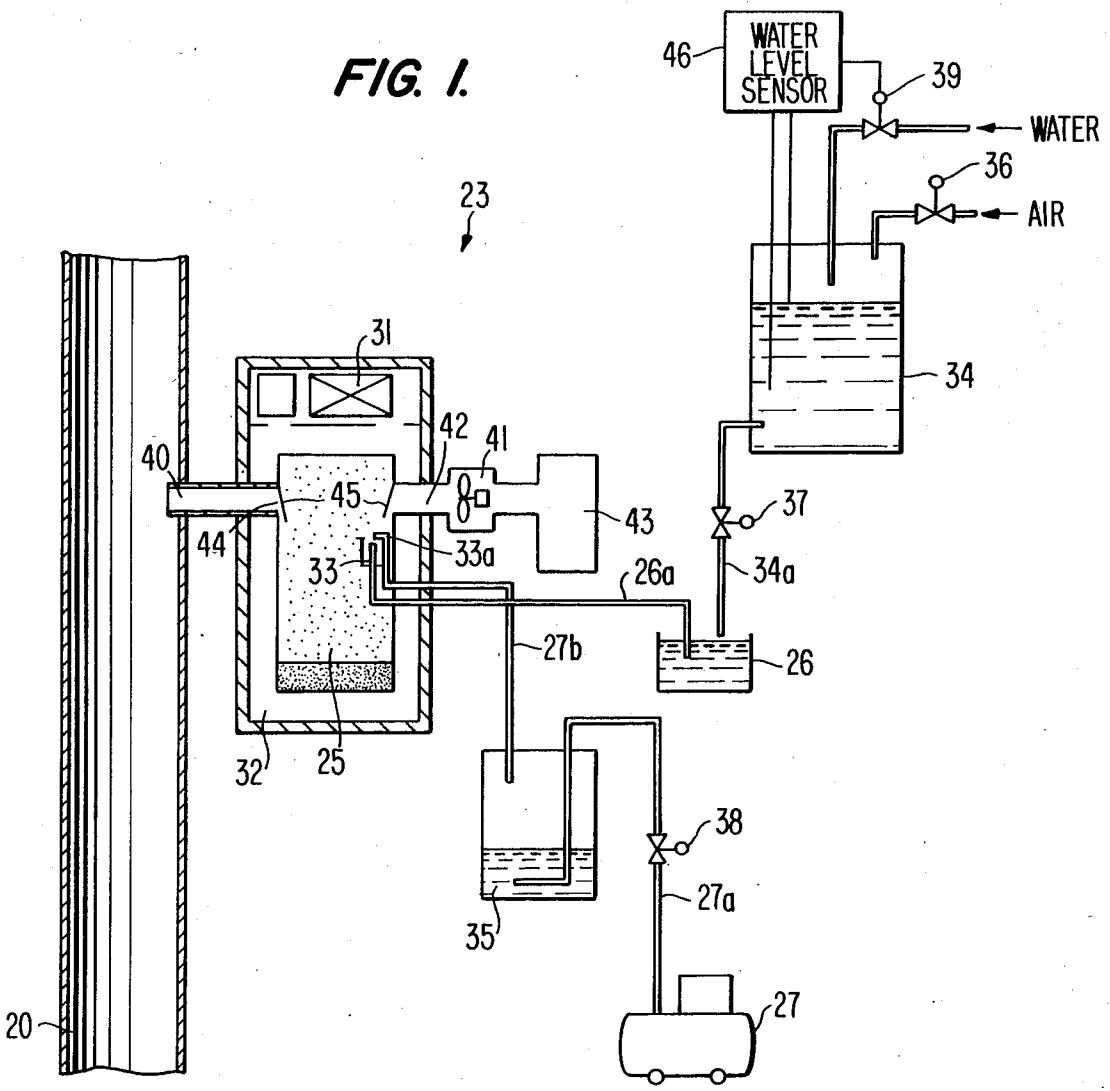
FIG. 1 is a longitudinal sectional view of an ice crystal feeder for use in the apparatus of the invention.
Figure 3:
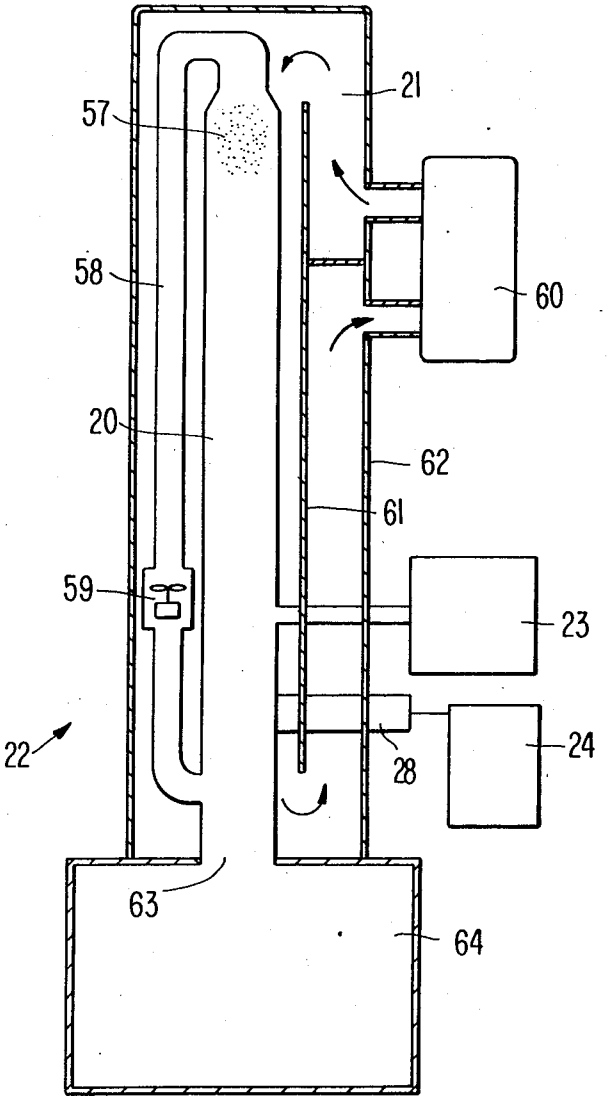
FIG. 3 is a longitudinal sectional view of a artificial snow generating apparatus in accordance with the present invention including the ice crystal feeder and cloud water feeder of FIGS. 1 and 2.

As shown in FIG. 3, an artificial snow generating apparatus 22 comprises a vertical inner cylinder 20 for generating and growing snowflakes and an outer tank 21 around the inner tank for cooling the inner cylinder 20. An ice crystal quantitative feeder 23 and a cloud-forming water quantitative feeder 24 are connected to inner cylinder 20 and supply controlled amounts of ice crystals and water to form a cloud so as to generate a predetermined quantity of snow having flakes of a predetermined shape and to cause a snowfall in the inner cylinder 20. In the ice crystal quantitative feeder 23, as shown in FIG. 1 and which will be described in more detail hereinafter, a feed water tank 26 is connected to a spray chamber 25 so as to supply a predetermined quantity of water thereinto and air having a high humidity is introduced from an air compressor 27 or the like through a saturation tank 35 into the spray chamber 25 so as to spray the water from the feed water tank 26 into the spray chamber 25 to generate a predetermined quantity of ice crystals having a predetermined particle size. Then the predetermined quantity of ice crystals are supplied into the inner cylinder 20.

In accordance with the present invention, a predetermined quantity of water is sprayed from nozzles 33 and **33*a* into the spray chamber 25**.

Since the spray chamber 25 is cooled to a predetermined temperature (e.g., −49° C.), the particles from the nozzles are instantaneously frozen into ice crystals and float in the spray chamber. Ice crystals having a particle size greater than a certain particle size drop onto the bottom surface of the spray chamber 25, and after the passage of a predetermined period of time, only ice crystals having a particle size below a predetermined particle size float inside the spray chamber, and all these ice crystals are sent into the inner cylinder 20 by a blower 41. As a result, only the ice crystals having a particle size below a predetermined range are supplied into the inner cylinder 20.

The particle size of the ice crystals supplied into the inner cylinder 20 is established by the diameters of the nozzles 33 and 33*a*, and the quantity of the feed water and the air flow rate from the saturation tank 35 establish the quantity of ice crystals.

Figure 2:
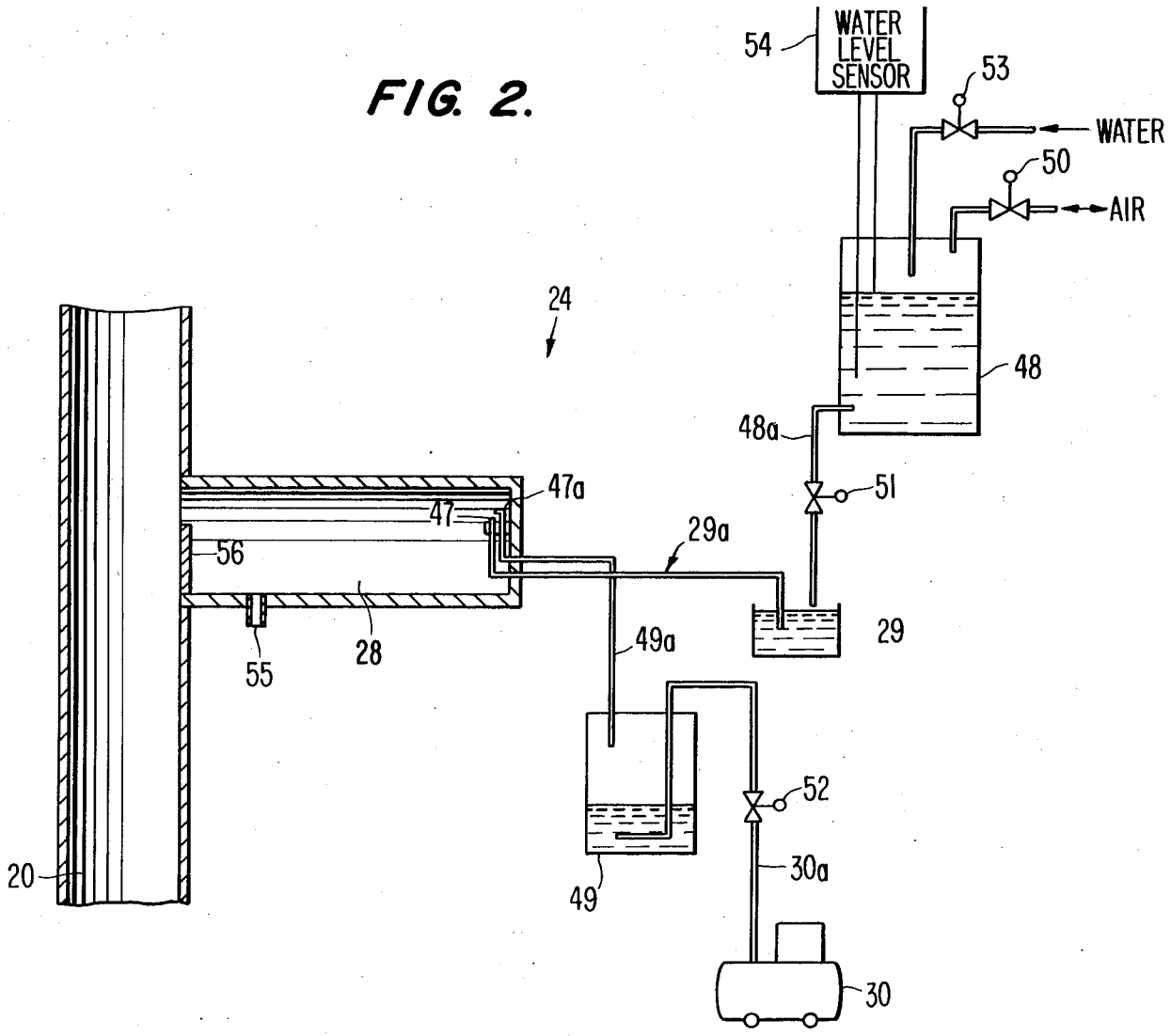
FIG. 2 is a longitudinal sectional view of a cloud water feeder for use in the apparatus of the invention.
Figure 4:
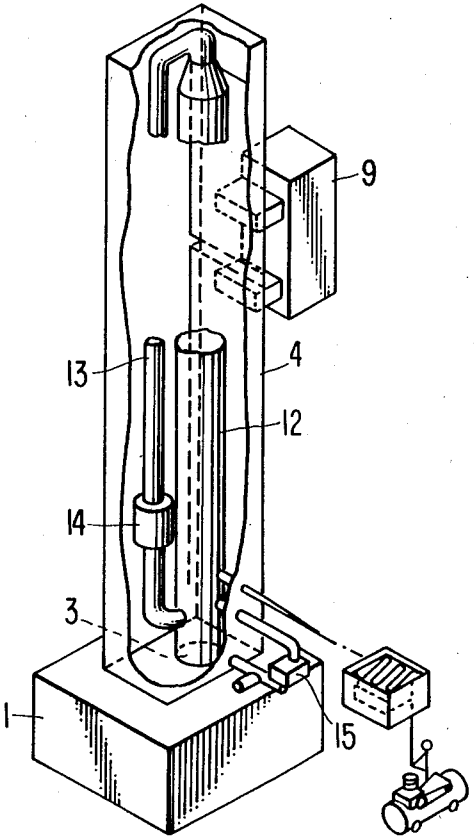
FIG. 4 is a partially cut-away perspective view of a prior art artificial snow generating apparatus.

In the cloud-forming water quantitative feeder 24 as shown in FIG. 2 and which will be described in detail hereinafter, a feed water tank 29 is connected to a particle classification pipe 28 and air having a high humidity is introduced through a saturation tank 49 into the particle classification pipe 28 from an air compressor 30 or the like, in order to spray the water from the feed water tank 29 into the particle classification pipe and to generate a predetermined quantity of cloud-forming water particles having a predetermined particle size. The thus formed cloud-forming water particles having a predetermined particle size is supplied into the inner cylinder 20 in order to generate a predetermined quantity of snow having flakes of a predetermined shape and to make it possible to generate the snowfall.

In the cloud-forming water quantitative feeder 24, a predetermined quantity of water is sprayed from a nozzle 47 into the particle classification pipe 28 by a predetermined operation.

The particles sprayed from the nozzle 47 by the compressed air from nozzle 47*a* are classified into small particles which are light in weight and large particles which are heavy due to the difference of their falling speeds as they pass through the particle classification pipe 28.

As a result of this classifying action, only particles having a particle size below a predetermined diameter are supplied as the cloud-forming particles into the inner cylinder 20, so as to cause the shape of the snowflakes generated inside the inner cylinder 20 to be constant.

The size of the cloud-forming water particles supplied into the inner cylinder 20 is established by the diameter of the nozzles 47 and 47*a*, and the amount is established by the feed water quantity and the air flow rate from the saturation tank 49.

In the manner described above, the particle size of the ice crystals supplied into the inner cylinder 20 for generating the snow is made constant and the quantity is established and at the same time, the water particle size of the cloud-forming water is made uniform. Accordingly, the snowflakes having a predetermined shape can be formed and the quantity of snow can be controlled arbitrarily.

FIG. 1 shows a preferred embodiment of an ice crystal quantitative feeder 23. A spray chamber 25 is provided. Since it must be cooled to about −40° C., for example, the spray chamber 25 is housed within a cooling chamber 32 having a cooler 31 therein. Cooling of the air in the cooling chamber 32 indirectly cools the interior of the spray chamber 25.

A feed water tank 26 is connected to the spray chamber 25 by a supply pipe 26*a* having a nozzle 33 on the end thereof within the spray chamber 25. A sealed feed water tank 34 is provided which is connected by supply pipe 34*a* to the feed water tank 26 to supply a predetermined quantity of water to feed water tank 26 under the control of an electromagnetic water valve 37.

An air compressor 27 is provided which supplies compressed air through compressed air supply pipe 27*a* to a body of water in an air saturation tank 35 under the control of an electromagnetic valve 38. Saturated compressed air, formed by bubbling the compressed air from compressor 27 through the water in air saturation tank 35, is in turn supplied through air supply pipe 27*b* to an aspirating nozzle 33*a* adjacent water nozzle 33 for aspirating water through nozzle 33 and atomizing it into spray chamber 25.

A predetermined quantity of water from the sealed feed water tank 34 is supplied to the feed water tank 26 by admitting atmospheric pressure air through an electromagnetic valve 36 while the feed water electromagnetic valve 37 is open. The predetermined quantity of water is established by keeping the time the electromagnetic valves 36 and 37 are open constant, or by putting an overflow on the feed water tank 26, so that only a predetermined level of water is stored in feed water tank 26.

After a predetermined amount of water is supplied to feed water tank 26, the electromagnetic valve 38 is opened to cause this quantity to be sprayed into the spray chamber 25 at the same time, to replenish the water in tank 34, the feed water electromagnetic valve 39 and electromagnetic valve 36 are opened to permit a predetermined quantity of water to be supplied into the feed water tank 34. This quantity is controlled by a water level sensor 46 which closes valves 36 and 39 when the level corresponding to the desired quantity is reached, thus sealing tank 34.

The atomized particles from the nozzle 33 inside the spray chamber 25 are instantaneously frozen and, if sufficiently small, float in the air in spray chamber 25, because the inside of the spray chamber is kept at a temperature as low as about −40° C., for example.

An amount of water is put on the bottom surface of the spray chamber 25 and frozen, and the inside of this chamber is always kept in a saturated state, lest part of the floating ice crystals evaporate and the crystals become smaller.

If the particles atomized from the nozzle 33 are frozen into ice crystals, those ice crystals having a greater particle size than a predetermined particle size fall onto the ice on the bottom surface of the spray chamber 25. After the passage of a predetermined period of time, only ice crystals having a particle size below a certain size float inside the spray chamber 25.

An ice crystal introducing pipe 40 is connected between the upper part of spray chamber 25 and cylinder 20 of the artificial snow generating apparatus. The discharge port 42 of a blower 41 is formed in the wall of spray chamber 25 on the opposite side from the pipe 40. The blower 41 is connected to a humidifier 43.

A switch valve 45, shown schematically, for sealing the spray chamber 25 is provided in each of the discharge ports 44 and 42 of the introducing pipe 40 and blower 41, and these valves 45 are normally closed.

After the passage of the predetermined period of time and when only ice crystals below a certain size are floating in chamber 25, the two switch valves 45 are opened and the blower 41 is actuated simultaneously. Humidified air is blown into the chamber 25 and all the ice crystals floating inside the spray chamber 25 are fed into the inner cylinder 20 of the artificial snow generating apparatus through the introducing pipe 40.

After sufficient air is blown so that all the ice crystals are removed, humidified air containing no ice crystals fills the spray chamber 25. The blower 41 is then stopped and the switch valves 45 are closed, thereby finishing the ice crystal feed operation.

The particle size and quantity of the ice crystals supplied into the inner cylinder 20 of the artificial snow generating apparatus in the manner described above are controlled by the diameters of the nozzles 33 and 33*a*, the quantity of feed water and the air flow rate from the saturation tank 35.

When, for example, the diameter of the nozzle 33 is large, ice crystals having a large particle size can be obtained, and when the diameter is small, ice crystals having a small particle size can be obtained.

When the quantity of feed water and the air flow rate are great, the quantity of ice crystals becomes great and when they are small, the quantity of the ice crystals becomes small.

The desired shape of the snowflakes can be obtained by suitably selecting the nozzle diameter and thus the ice crystal particle size, and the desired quantity of snow can be obtained by suitably selecting the quantity of feed water and the air flow rate.

As a specific example, when the diameter of the nozzle 33*a* is 0.5 mm and the diameter of the nozzle 33 is 0.7 mm and the particles are atomized with air at an air pressure of 1 kgf/cm$^2$, the number of particles produced is about $1.7\times10^8$/min.

Among the particles, about 30% of particles drop because their particle size is too great, and the number of particles supplied as the ice crystals to the inner cylinder 20 is about $1.2\times10^8$/min.

To limit the number of particles supplied into the inner cylinder, the spray time is controlled at the rate described above and the quantity of ice crystals can be controlled easily.

FIG. 2 shows a preferred embodiment of a cloud-forming water quantitative feeder 24. A feed water tank 29 is connected by a supply pipe 29*a* to a particle classification pipe 28 which is directly connected to the inner cylinder 20 of the artificial snow generating apparatus 22. Supply pipe 29*a* has a nozzle 47 on the end directed into the classification pipe 28. A sealed feed water tank 48 is provided which is connected by supply pipe 48*a* to the feed water tank 29 so as to supply a predetermined quantity of water to feed water tank 29 under the control of an electromagnetic feed water valve 37.

An air compressor 30 is provided which supplies compressed air through compressed air supply pipe 30*a* to a body of water in an air saturation tank 49 under the control of an electromagnetic valve 52. Saturated compressed air, formed by bubbling the compressed air from compressor 30 through the water in air saturation tank 49, is in turn supplied through air supply pipe 49*a* to an aspirating nozzle 47*a* adjacent water nozzle 47 for aspirating water through nozzle 47 and atomizing it into particle classification pipe 28.

A predetermined quantity of water from the sealed feed water tank 48 is supplied to the feed water tank 29 by admitting air through an electromagnetic valve 50 while feed water electromagnetic valve 51 is open. The predetermined quantity of water is established by either keeping the time the electromagnetic valves 50 and 51 are open constant, or by putting an overflow on the feed water tank 29, so that only a predetermined level of water is stored in feed water tank 26.

After a predetermined amount of water is supplied to feed water tank 26, the electromagnetic valve 52 is opened to cause this quantity to be sprayed into the classification pipe 28. To replenish the water in tank 48, the electromagnetic valve 53 and air valve 50 are opened in order to admit a predetermined quantity of water into the feed water tank 48. This quantity is controlled by a level sensor 54 which closes valves 53 and 50 when the level corresponding to the desired quantity is reached, to thus seal tank 48.

The water particles jetted from the nozzles 47 and 47*a* into the particle classification pipe 28 pass through the particle classification pipe 28 where they are classified into light and small particles and heavy and large particles due to the difference in the speeds with which they fall. A classification wall 56 is mounted on the end of the classification pipe 28 where it opens into the inner cylinder 20, particles having a particle size above a predetermined level fall below the level of the top of the wall 56 during passage through the particle classification pipe 28 and are discarded through a discharge port 55.

Only the particles having a particle size below a predetermined particle size will stay afloat sufficiently during passage through the particle classification pipe 28 to pass above the top of the wall 56 and these are supplied into the inner cylinder 20.

The moisture content (cloud water content) in inner cylinder 20 at this time is adjusted to 0.8 g/m$^3$, for example. This cloud water content is determined experimentally from the quantity of water from the feed water tank 29, the air flow rate from the saturation tank 49, the diameter of the nozzles 47 and 47*a*, and the like.

Particles having a larger particle size can be obtained by increasing the diameter of the nozzle 47, for example, and particles having a smaller particle size can be obtained by reducing the diameter of the nozzle 47.

The quantity of the particles can be increased by increasing the quantity of feed water and the air flow rate, and can be reduced by reducing the quantity of feed water and the air flow rate.

A desire shape of the snowflakes and a desired quantity of snowfall can be obtained by suitably selecting the nozzle diameter, the quantity of feed water and the air flow rate.

As a specific example, when the diameter of the nozzle 47 is 0.5 mm and the diameter of nozzle 47*a* is 0.7 mm, and the spray is produced by an air pressure of 1 kgf/cm$^2$, the water is jetting at a rate of about 1.6 g/min.

About 30% of the particles fall below the wall 56 in the particle classification pipe 28, and water is supplied into the inner cylinder 20 at a rate of about 1.1 g/min. In order to obtain a quantity of cloud-forming water of 0.8 g/m$^2$, for example, water must be jetted for about 44 seconds per cubic meter.

The shapes of the snowflakes can be made constant and the quantity of snowfall can be controlled easily by setting the quantity of the ice crystals generated in the spray chamber 25 to $10^5$ to $10^9$ particles/m$^3$ and the quantity of cloud-forming water from the particle classification pipe to 0.7 to 1.0 g/m$^3$.

In FIG. 3, reference numeral 57 designates a space at the top of the inner cylinder, 58 designates a circulation pipe, 59 designates a variable speed blower, 60 designates a cooler, 61 designates a partition, 62 designates a cooling tower, 63 designates an opening and 64 is a snow collecting chamber.

In accordance with the present invention described above, it is possible to control arbitrarily the cloud-forming water particle size and quantity of cloud-forming water as well as the particle size and quantity of the ice crystals which are the nuclei of the snowflakes that are significant factors for determining the shape of the snowflakes and the quantity of snowfall. Accordingly, the shape of the snowflakes can be made uniform and the quantity of snowfall can be controlled and the desired artificial snow for use in various studies and experiments can be obtained easily.

While a preferred embodiment of the invention has been described, it will be obvious to those skilled in the art that various changes and modifications may be made without departing from the scope and spirit of the invention, and the scope of the invention is therefore to be determined solely by the appended claims.

What is claimed is:

1. In an artificial snow generating apparatus having a vertical inner cylinder for generating and growing snow and an outer tank surrounding the inner cylinder and including means for cooling the air in the outer tank for thereby cooling said inner cylinder, the improvement comprising:

an ice crystal quantitative feeder for generating and feeding a predetermined quantity of ice to a lower part of the inner cylinder and having a cooled spray chamber connected to said inner cylinder, a spray producing nozzle means in said spray chamber, a feed water tank connected to said spray producing nozzle means, a saturation tank containing water connected to said spray producing nozzle means, a compressed air means connected to said saturation tank for directing compressed air through the water in said saturation tank and into said spray chamber through said nozzle means to produce a spray of water into said spray chamber from said feed water tank, and means for periodically blowing humidified air through said spray chamber to blow ice particles into the inner cylinder; and a cloud-forming water quantitative feeder for generating and feeding a predetermined quantity of particles of cloud-forming water having a predetermined particle size to the inner cylinder at a position above said ice crystal quantitative feeder and having a particle classification pipe connected to said inner cylinder, a further spray producing nozzle means in said particle classification, a further feed water tank connected to said particle classification pipe, a further saturation tank containing water connected to said further spray producing nozzle means, a further compressed air means connected to said further saturation tank for directing compressed air through the water in said further saturation tank and into said classification pipe through said further nozzle means to produce a spray of water particles into said classification pipe from said further feed water tank, said particle classification pipe including means for separating particles larger than a predetermined size from the spray of water particles and for passing the remainder of the water particles into the inner cylinder.

2. The improvement as claimed in claim 1 in which said ice crystal quantitative feeder further comprises a cooling chamber surrounding said spray chamber and having a cooler for cooling the air in said cooling chamber for cooling said spray chamber, and said nozzle means comprises a first nozzle connected to said feed water tank and a second nozzle connected to said saturation tank for directing humidified compressed air across said first nozzle for aspirating water from said feed water tank and forming a spray thereof, and said means for periodically blowing comprises a blower connected to said spray chamber and a source of humidified air connected to said blower, and valve means connected between said blower and said spray chamber and between said spray chamber and said inner cylinder.

3. The improvement as claimed in claim 1 in which said particle classification pipe comprises a pipe member having a discharge port opening into the inner cylinder and a classification wall at said discharge port for blocking water particles of a size larger than a predetermined size from passing through said discharge opening, and said further nozzle means is at the end of said pipe member remote from said discharge opening and has a further first nozzle connected to said further feed water tank and a further second nozzle connected to said further saturation tank for directing humidified compressed air across said further first nozzle for aspirating water from said further feed water tank and forming a spray in said pipe member.

* * * * *